United States Patent [19]

Marshall

[11] 4,430,762

[45] Feb. 14, 1984

[54] AQUASSAGE

[76] Inventor: Mark Marshall, Rte. 3, Box 49-A-9, Prairieville, La. 70769

[21] Appl. No.: 419,729

[22] Filed: Sep. 20, 1982

[51] Int. Cl.[3] ..... A61H 33/02

[52] U.S. Cl. ..... 4/543; 4/541; 128/66

[58] Field of Search ..... 4/543, 541, 542, 490, 4/492; 128/66

[56] References Cited

U.S. PATENT DOCUMENTS

| | | | |
|---|---|---|---|
| 1,034,919 | 8/1912 | Leuschner | 4/543 |
| 1,350,974 | 8/1920 | Kolshorn | 4/543 |
| 1,699,198 | 1/1929 | Millmather | 4/543 |
| 3,467,969 | 9/1969 | Szekely | 4/543 |
| 4,225,984 | 10/1980 | Lindsey | 4/541 |
| 4,249,522 | 2/1981 | Carrier | 4/543 |

FOREIGN PATENT DOCUMENTS

| | | | |
|---|---|---|---|
| 731838 | 4/1966 | Canada | 4/543 |
| 2912006 | 10/1980 | Fed. Rep. of Germany | 4/541 |
| 2940863 | 4/1981 | Fed. Rep. of Germany | 4/543 |
| 1352270 | 1/1964 | France | 4/543 |
| 951804 | 3/1964 | United Kingdom | 4/543 |

*Primary Examiner*—Henry K. Artis
*Attorney, Agent, or Firm*—Keaty & Keaty

[57] ABSTRACT

An aquassage apparatus for agitating water in a bath tub has a flexible, soft tubing which is pliable enough to be bent into different configurations. Suction cups are glued to the bottom of the tubing for secure attachment to the bottom of the bath tub. The tubing has a plurality of perforations for allowing compressed air to be horizontally injected therethrough. The tubing is connected to a tee junction at one end, the tee junction is connected via a valve to an exhaust port of a vacuum cleaner. The valve of the present invention has a cylindrical housing with a closed (capped) outer end with a plurality of slots and an open inner end connected to the exhaust port of the vacuum cleaner. The valve housing is provided with a lower annular valve seat sealingly engaged with the interior wall of the housing, a transverse port through one side of the housing above the valve seat and a bored cylindrical connector receptacle fluidly communicating with the transverse port and fluidly connected to the air feeder hose. Air slots provided through the sides of the housing below the valve seat can be open or closed by special flaps hingedly mounted to the interior wall of the housing. A spherical valve member within the housing is actuated by pressurized air which can move the valve member from the transverse port to a fluidly sealing engagement with the valve seat.

The invention also provides a method of operating the aquassage apparatus.

17 Claims, 8 Drawing Figures

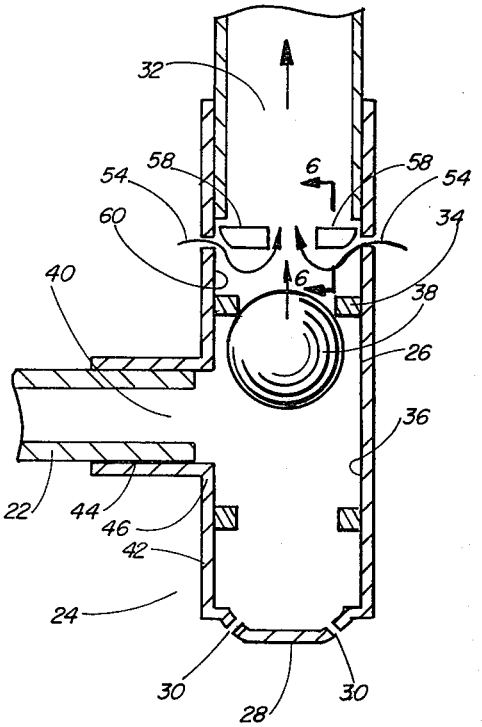
FIG. 4
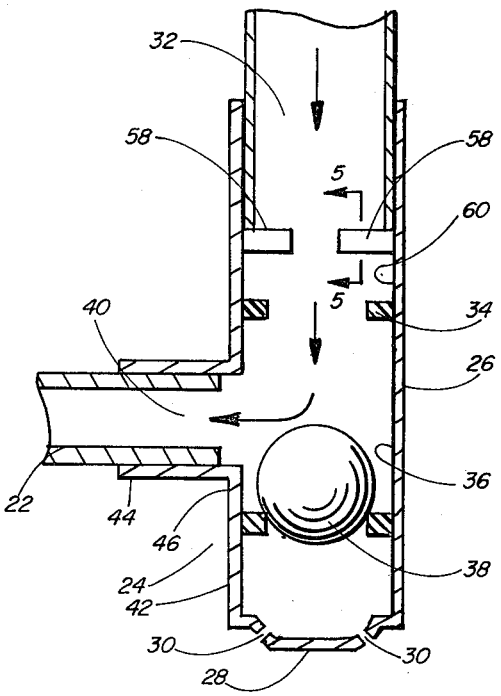
FIG. 3
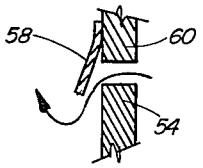
FIG. 5
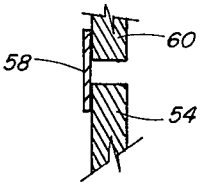
FIG. 6
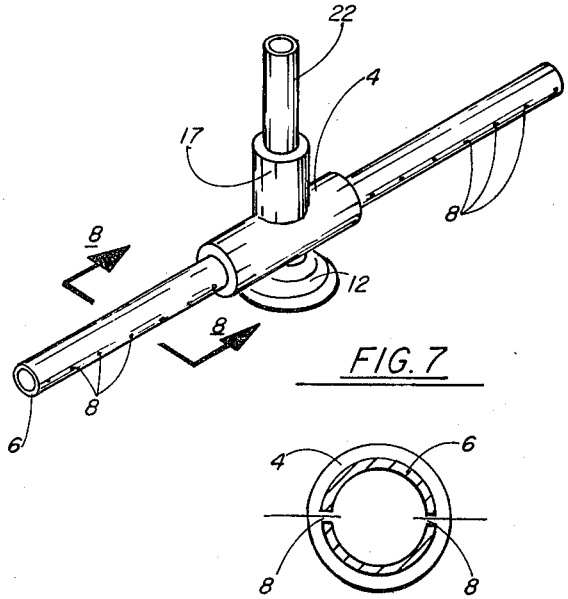
FIG. 7
FIG. 8

AQUASSAGE

BACKGROUND OF THE INVENTION

1. Field of the Invention

The present invention pertains generally to an improved water aerator apparatus of the type immersible in a tub of water for directing jets of air into the water for producing a hydrotherapeutic, hydromassage, or the like effect on a person situated in the tub, or for generally recreational purposes, such as creating bubble baths or the like.

2. Background of the Invention

Prior art devices such as whirlpools and the like are well known for injecting streams of water that have a massaging effect on the body of the user. These water injecting devices provide a relaxing and soothing effect that may have many uses. Several disadvantages are attendant these devices, however. They are quite expensive and have a complicated structure that normally requires a paticularly designed tub or bath container for receiving the water injecting equipment and for correctly directing and containing the injected water.

There also presently exist several devices which attempt to reduce the cost of and simplify the apparatus to produce the desired effect. Many of these devices teach the use of a compressor or blower apparatus, which can be a vacuum cleaner, for example, to force air through a tubing passage which is preferably removably mounted by means of suction cups, for example, to the bottom of the bath container or tub, and into the water contained therein. Apparatus of this general type are fairly well known in the prior art. However, many problems have arisen with respect to these devices of the prior art which have rendered them unworkable in actual practice and unsafe in some respects, with regard to both the operator and the vacuum cleaner. In particular, when a vacuum cleaner is employed as a source of compressed air, the air feeder hose, which has generally been the vacuum cleaner hose, should be connected to the exhaust port thereof. However, if the operator accidentally connects the air feeder hose to the suction port of the vacuum cleaner, monumental problems result, as the water in the bath tub is suctioned, or backflowed, through the air feeder hose into the vacuum cleaner, with the consequence of "short circuiting" the vacuum cleaner and thereby electrocuting the person in the bath tub who is using the apparatus, resulting in great harm or death to such person. Some later devices of the prior art have attempted to overcome this serious disadvantage of the prior art by means of mounting a check valve within the air feeder hose, which allows flow from the vacuum cleaner into the bath tub, but which prohibits the backflow of water from the bath tub into the vacuum cleaner. However, these devices have been largely unsuccessful in preventing the undesirable backflow (and when successful, irreparable damage to the vacuum cleaner has occurred), have escalated the cost to the consumer for the device, and have also inhibited the amount of compressed air allowed to flow from the vacuum cleaner through the air feeder hose and into the water in the bath tub, thereby decreasing the effectiveness of the device for creating air bubbles in the water, thereby ultimately lessening the desired effect of the apparatus. The present invention has as a primary objective the provision of a check valve assembly which eliminates these major disadvantages of the prior art. Particularly, the present invention teaches a generally cylindrical valve assembly housing having a closed, outer end and an open, inner end, wherein said valve assembly housing comprises a lower valve seat and a transverse port just thereabove communicating with the bore of a generally cylindrical connector receptacle which is fixably attached to, or integrally formed with the outer surface of said valve assembly housing. Many of the important, novel aspects of the present invention reside in said valve assembly housing, which comprises a generally spherical ball valve member, which is actuatable by pressurized fluid for movement between open and closed positions, whereby said ball valve member is in fluidly sealing, seating engagement with said lower valve seat in said closed position and whereby said ball valve member is disposed beyond said transverse port of said housing when in said open position, for thereby facilitating the transmission of said pressurized fluid through an air feeder hose and thence through horizontal perforations provided in said tubing passage and into said water for thereby agitating said water; and wherein said closed, outer end of said housing comprises a plurality of apertures, or air-slots, for facilitating escape of trapped air within said housing inner chamber between said spherical ball valve member and said closed, outer end of said housing, thereby enabling said ball valve member to clear said transverse port of said housing for thereby permitting maximum possible flow of said pressurized air from said exhaust port of said vacuum cleaner through said air feeder hose and said tubing passage and through said perforations of said tubing passage into said water contained by said bath tub or bath container. Said tubing passage is made of a flexible and pliable enough material, preferably an elastomeric material, to enable it to be manipulated into any desired configuration within said bath container or bath tub. The tubing passage of the present invention is referred to as an air bubble generating hose mat for generating air bubbles or similarly for imparting agitation to the water contained by said bath tub or bath container for purposes such as hydrotherapy, hydromassage, or recreational purposes such as creating bubble baths with bubble bath soap, etc. The contemplted appliance is an improvement with respect to feasibility of operation of the device, and in particular, with regard to an improved check valve for preventing backflow of water through the compressed air feeder hose into the vacuum cleaner and for allowing maxiumum compressed air flow therethrough and through the air bubble generating hose mat for generation of the maximum amount of air bubbles to produce the desired level of agitation to the water within said bath tub or bath container. Further, the present invention features suction attachments for securing the air bubble generating hose mat to the bottom surface of the bath tub, wherein said suction attachments are integral to or glued to the hose, rather than screwed thereto or attached in any other manner taught by the prior art, thereby reducing the cost of the apparatus to the consumer, and simplifying the character of and construction of the apparatus. An additional, significant improvement of the present invention is the provision of a safety feature which prevents damage to the vacuum cleaner or other source of pressurized air, and in particular, which prevents a "burning up" of the air motor of said source of pressurized air. Said safety feature comprises, in the preferred embodiment, rubber flaps provided on said valve assembly housing between said lower, valve seat thereof and said exhaust port of said vacuum cleaner or other source of pressurized air. Said safety feature of the present invention allows atmospheric air to be suctioned into said vacuum cleaner in the event that said air feeder hose is accidentally connected to the suction port rather than the exhaust port of said vacuum cleaner, thereby allowing the intake of atmospheric air, which provides a cooling effect to prevent burning up of the air motor contained therein. Further, said rubber flaps maintain their closed position during normal operation of the apparatus of the present invention, namely, when the air feeder hose is connected to the exhaust port of said vacuum cleaner, or other source of pressurized air, which is the normal operating mode of the present invention.

SUMMARY OF THE INVENTION

In the preferred embodiment, the present invention comprises a unitary length of flexible, pliable, soft, generally elastomeric tubing, termed a tubing passage, or air bubble generating mat, which has sufficient properties of pliability to enable the user to manipulate the tubing into any desired configuration of any desired size and shape. The present invention further comprises suction cups which are fixably mounted to, for example glued to, or integrally formed with, the bottom surface of said air generating mat, for facilitating removable, yet secure attachment, or installation thereof, to the bottom surface of said bath tub or bath container. This novel method of attachment reduces the cost of materials and labor necessary to construct the apparatus, which cost savings can be directly passed on to the consumer. Said tubing passage comprises a plurality of perforations through the sides thereof, thereby facilitating injection of compressed air (as hereinafter described) therethrough in a direction generally horizontal to the bottom surface of said bath tub or said bath container; this feature enables the user to lie upon said air bubble generating mat without inhibiting or prohibiting the air flow through said tubing passage and through the perforations thereof into the water contained by the bath tub or bath container. Further, said tubing passage is sufficiently soft so that the user can comfortably lie upon it, and sufficiently pliable to prevent pinching thereof which could inhibit or prohibit air flow therethrough.

In the preferred embodiment, said tubing passage is connected to a standard tee junction at one end thereof, preferably near the mid point of that end, and said tee junction is connected to a flexible air feeder hose which is connected by means of a valve assembly housing (hereinafter described) to the exhaust port of a vacuum cleaner, preferably, although it is to be understood that any other source of pressurized or compressed air, for example an air compressor or the like, may be employed in lieu thereof. It should be noted that it has been common practice in the prior art to utilize the air hose of the vacuum cleaner for conveying the pressurized air to the tubing passage. This has proven to be a problem, as the vacuum cleaner air hose, if not thoroughly cleaned before use of the apparatus, will usually contain dust and dirt, which is inevitably carried through the air hose into the tubing passage and ultimately injected through the perforations in the tubing passage, and thence into the water contained by the bath tub or bath container, thereby undesirably contaminating it. The separate and distinct air feeder hose of the present invention easily overcomes this disadvantage of the prior art.

The primary novel aspects of the present invention, however, reside in the valve assembly which is fluidly connected to the exhaust port of the vacuum cleaner. In the preferred embodiment, the valve assembly comprises a generally cylindrical valve assembly housing having a closed, or capped outer end and an open, inner end which is connected to the exhaust port of the vacuum cleaner. Said valve assembly housing further comprises a lower valve seat mounted therein in fluidly sealing engagement with the interior walls thereof, a transverse port through one side thereof just above said valve seat, and a bored, generally cylindrical connector receptacle fixably attached to, or integrally formed with the outer surface thereof, in fluidly communicating relationship with said transverse port, wherein said connector receptacle is fluidily connected to said air feeder hose for conveying pressurized air from said vacuum cleaner to said tubing passage mounted to the bottom surface of said bath tub or bath container. Said valve assembly further comprises a plurality of apertures, or air pressure escape ports, through said capped, outer end to permit the escape of air which may become trapped between said spherical ball valve member and said capped, outer end of said valve assembly housing, thereby ensuring clearance of said ball valve member from said transverse port of said housing, thereby permitting the maximum possible flow of said pressurized air from said source of pressurized air (i.e. said vacuum cleaner) and through said air feeder hose and said perforations of said air bubble generating mat, and thence into said water contained by said bath tub or said bath container.

BRIEF DESCRIPTION OF THE DRAWINGS

Other objects of the present invention will appear in the following description and appended claims, reference being made to the accompanying drawings forming a part of the specification wherein like referenced characters designate corresponding parts of the several views, wherein:

FIG. 3 is a cross-sectional, elevational, side view of the valve assembly of the present invention, in normal operating mode.

FIG. 4 is a cross-sectional, elevational, side view of the valve assembly showing the operation of the safety flaps.

FIG. 5 is a fragmentary cross-sectional view of the open position of one of the flaps, taken from the lines A—A in FIG. 4.

FIG. 6 is a fragmentary, cross-sectional view of the normal closed position of one of the flaps taken from the lines B—B in FIG. 3.

FIG. 7 is an isometric, fragmentary view of the tubing passage of the present invention.

FIG. 8 is a cross-sectional, end view of the tubing passage taken along the line C—C in FIG. 7.

DETAILED DESCRIPTION OF THE PREFERRED EMBODIMENT

Figure 1:
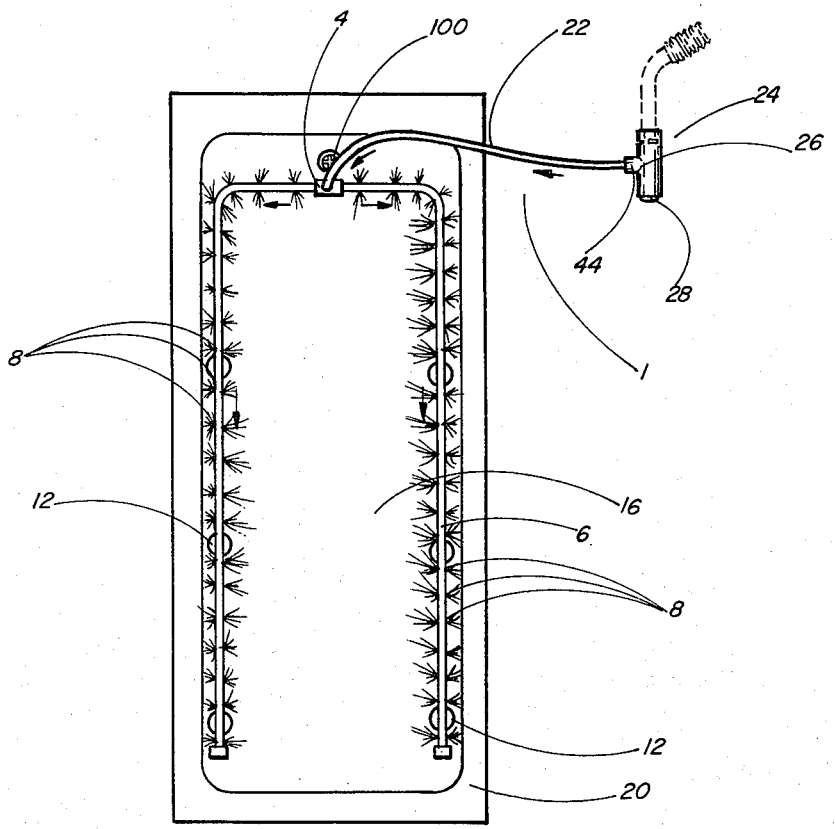
FIG. 1 is a top plan view of the entire apparatus of the present invention.
Figure 2:
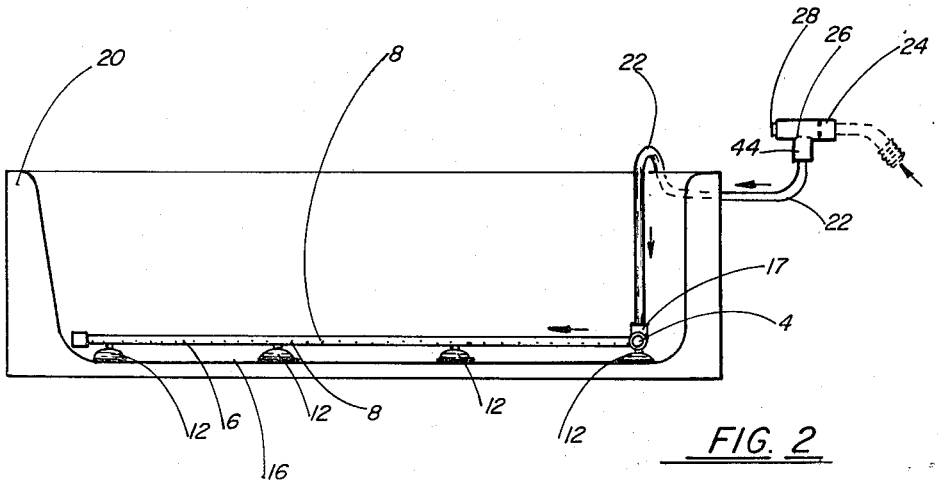
FIG. 2 is a cut-away, elevational, side view of the entire apparatus of the present invention.

There can be seen in FIG. 1 the apparatus of the present invention, designated generally by the numeral 1. The present invention comprises, in one of its aspects, a tubing passage 5, or air bubble generating mat 6, as seen partially in FIG. 7, having a plurality of perforations 8 perferably provided through the sides 10 thereof (although this should not be read in a limiting sense), shown in end view in FIG. 8, mounted or attached to the bottom surface 16 of a bath tub 20, or bath container 20, by means of suction cups 12 which are integrally formed with, or suitably fixably attached to, (e.g. by means of any super-adhesive glue) the bottom surface 14 of air bubble generating mat 6. In the preferred embodiment, tubing passage 6 is composed of a soft, flexible, resilient, elastomeric material, such as polyvinyl, having sufficient pliability to enable the user to manipulate said tubing passage 6 into any desired shape or configuration for any desired application thereof. Preferably, tubing passage 6 is comprised of a single, unitary length of elastomeric tubing for ease of handling and storage. Tubing passage 6 can be coiled up and attached to the wall (not shown) immediately adjacent to said bath tub 20 by means of the suction cups 12, for example. The soft characteristic of tubing passage 6 enables the user (not shown) to lie thereupon it and experience the therapeutic (e.g. hydromassage) effects thereof (as will hereinafter be discussed) without any discomfort and without pinching the tubing passage 6 so as to inhibit or prohibit airflow therethrough, or impede airflow any other way.

In the preferred embodiment, a standard tee junction 4 is employed preferably near the mid point of tubing passage 6, preferably toward the sump 100, or drain 100 of bath tub 20, as can be seen in FIGS. 1 and 7. Receptacle 17 of tee junction 4 is connected to air feeder hose 22, which is preferably an elongate, flexible conduit of any desired flow capacity or length. Air feeder hose 22 is connected at its other end to connector receptacle 44 of valve assembly housing 26 of valve assembly 24. As can be seen in cross-section in FIG. 3, valve assembly 24 comprises a valve assembly housing 26 having a capped, outer end 38 provided with a plurality of air escape ports 30 therethrough; an open, inner end 32; a lower, internal valve seat 34 mounted in fluidly sealing engagement with the inner walls 36 of said valve assembly housing 26; a transverse port 40 provided through one side 42 of housing 26 above valve seat 34; and a connector receptacle 44 preferably fixably attached to, or intergrally formed with the outer surface 46 of housing 26 in fluid communication with transverse port 40 thereof, for fluidly connecting air feeder hose 22 thereto. The open, inner end 32 of housing 26 is fluidly connected to a source pressurized air 2, shown as a standard household vacuum cleaner 2 in FIG. 1, although it should be recognized that any other suitable source of pressurized air, for example an air compressor, can be utilized. Open, inner end 32 of housing 26 is connected to the exhaust port 52 of vacuum cleaner 2. Further, valve assembly housing 26 contains a preferably generally spherical ball valve member 28 which is actuatable by pressurized air for movement between an open, or operating position, whereby said ball valve member 38 is completely forced out of the way of said transverse port 40 of housing 26, and a closed position whereby said ball valve member 38 is in fluidly sealing, seating engagement with lower, valve seat 34, for reasons which will be hereinafter seen.

In operation, the aquassage apparatus of the present invention works in the following simple manner:

1. Vacuum cleaner 2 is energized in the normal manner, thereby causing pressurized air to pass through air feeder hose 22 and through the tubing passage 6, or air bubble generating mat 6, and through the perforations 8 thereof, and into the water contained by the bath tub 20, or bath container 20, thus disturbing the water by having thousands of soft, tiny air bubbles that are directed inwardly and upwardly in an action to substantially encircle and cover the limbs and torso of the user. This creates distrubance in the water that provides the massaging effect as is well known in the prior art;
2. When the user has finished using the aquassage 1, he merely deenergizes the vacuum cleaner 2 in the normal manner, thus causing a cessation of the pressurized air through the tubing passage 6, with the obvious consequence that no further air bubbles are generated within the water contained by the bath tub 20, or bath container 20;
3. Any air which is trapped within valve assembly housing 26 is caused to escape through air escape ports 30 provided through the capped, outer end 28 of valve assembly housing 26, so that during further use of the aquassage of the present invention, the pressurized air will force the ball valve member 38 against the capped, outer end 28 of valve assembly housing 26, thereby providing total clearance of ball valve member 38 with transverse port 40 of housing 26, thereby permitting maximum flow of pressurized air therethrough and through air feeder hose 22 and air bubble generating mat 6 in a manner hereinabove described, as can be seen in FIG. 3;
4. Further, the present invention comprises novel safety features in the event that a user inadvertently connects the open, inner end 32 of housing 26 to the suction port 50 rather than the exhaust port 52 of vacuum cleaner 2:
   a. in the event that the above inadvertent connection is made, the suction created by the vacuum cleaner 2 will force the ball valve member 38 into fuidly sealing, seating engagement with lower, internal valve seat 34, thereby preventing the backflow of water from the bath tub 20, or bath container 20 into the vacuum cleaner 2, as seen in FIG. 4, which if allowed, would cause short-circuiting of the vacuum cleaner 2, ultimately resulting in electrocution of the user situated in the bath tub 20, which could result in great bodily harm or death to said user;
   b. valve assembly housing 26 comprises a plurality of air slots 54, as seen in FIGS. 5 and 6, provided through the side 56 thereof, below valve seat 34 thereof, and flaps 58, preferably made of rubber or a like material, hingedly mounted by means of glue, for example, on one end thereof to the interior walls 60 of housing 26 below valve seat 34, as can be seen in FIGS. 3 and 4; the suction created by the vacuum cleaner 2 in the event of the inadvertent connection above described, will cause flaps 58 to open inwardly, thereby allowing atmospheric air to enter through open, inner end 32 of housing 26 and into vacuum cleaner 2, thereby preventing damage to vacuum cleaner 2, such as "burning up" of the air motor contained therein, as shown in FIG. 5.

While the acquassage apparatus of the present invention has been shown and described in some detail, it is obvious that this invention is not to be considered as being limited to the exact form disclosed, and that changes in detail and construction may be made therein within the scope of the invention, without departing from the spirit thereof.

Having thus set forth and disclosed the nature of the present invention, what is claimed is:

1. An aquassage apparatus for blowing pressurized air within a water-filled bath tub for agitating said water, comprising:

a. a soft, flexible, elongate tubing passage comprising attachment means for thereby facilitating mounting thereof in any desired configuration, within said bath tub;

b. an air feeder hose connected to said tubing passage for introducing pressurized fluid thereinto;

c. a plurality of perforations provided through said tubing passage for facilitating the injection of pressurized fluid therethrough into said water-filled bath tub for agitating said water contained therein;

d. a valve assembly, comprising:

i. a valve assembly housing having a capped, outer end provided with a plurality of air slots therethrough; a lower, internal valve seat; a transverse port through one side thereof above said valve seat; an open, inner end; connection means provided on the outer surface of said housing in fluid communication with said transverse port, whereby said connection means is connected to said air feeder hose for introducing pressurized fluid thereinto; a plurality of air slots provided through the sides of said housing below said valve seat and a plurality of flaps, each of which is hingedly mounted to the interior walls of said housing below said valve seat in covering relationship to said air slots, for movement between open and closed positions;

ii. a valve member contained by said housing actuatable by said pressurized air for movement between an open position whereby said valve member is forced completely out the way of said transverse port of said housing and a closed position whereby said valve member is forced by said pressurized air into fluidly sealing, seating engagement with said valve seat;

e. a source of pressurized fluid connected to said open, inner end of said housing for conveying pressurized air through said transverse port of said housing and into said air feeder hose, and through said perforations of said tubing passage for blowing pressurized air within said water-filled bath tub, for thereby agitating said water.

2. The apparatus of claim 1, wherein said source of pressurized fluid comprises a vacuum cleaner having an exhaust port and a suction port.

3. The apparatus of claim 2, wherein said vacuum cleaner is a standard, household vacuum cleaner.

4. The method of operating the apparatus of claim 3, comprising the following steps:

a. energizing said vacuum cleaner and conveying pressurized air through the inner end of said value assembly housing, thereby forcing said valve member upwardly within said valve assembly housing and completely out of the way of said transverse port of said housing, and further passing said pressurized air through said air feeder hose, and said tubing passage, and through said perforations of said tubing passage into said water-filled bath tub, thereby agitating said water;

b. de-energizing said vacuum cleaner upon discontinuance of use of said aquassage apparatus, thus expelling any air trapped within said valve assembly housing through said air escape slots of said capped, outer end of said valve assembly housing to the atmosphere, thereby enabling said valve member to be forced completely upwardly within said housing and completely out of the path of said transverse port of said housing, thereby facilitating maximum pressurized air flow therethrough upon further use of said aquassage;

c. providing safety means in case of an inadvertent connection of said open, inner end of said valve assembly housing to said suction port rather than exhaust port of said vacuum cleaner, said means allowing said valve member to move into fluidly sealing, seating engagement with said lower valve seat, thereby preventing backflow of said water contained by said bath tub into said vacuum cleaner and further allowing said flaps of said housing to move into their open position, thereby permitting atmospheric air to enter through said air slots and into said vacuum cleaner, thereby cooling the interior thereof.

5. The apparatus of claim 3, wherein said tubing passage is composed of a soft, flexible, elastomeric material.

6. The apparatus of claim 5, wherein said tubing passage is composed of polyvinyl material.

7. The apparatus of claim 6, wherein said perforations are provided through the sides of said tubing passage, thereby enabling a user to lie upon said tubing passage when situated in said bath tub, without inhibiting or prohibiting airflow therethrough.

8. The apparatus of claim 7, wherein said tubing passage possesses sufficient characteristics of softness and pliability, to enable a user to lie upon said tubing passage with no discomfort and without any problems of pinching said tubing passage, which would inhibit or prohibit airflow therethrough.

9. The apparatus of claim 8, wherein said attachment means of said tubing passage comprises a plurality of suction cups fixably mounted to the bottom surface thereof, in spaced-apart relationship to each other.

10. The apparatus of claim 9, wherein said suction cups are glued to the bottom surface of said tubing passage by means of any super-adhesive glue.

11. The apparatus of claim 10, wherein said air feeder hose is connected to said tubing passage by means of a standard tee juntion.

12. The apparatus of claim 11, wherein said air feeder hose comprises a flexible, elongate tubing.

13. The apparatus of claim 12, wherein said flaps of said valve assembly housing are made of rubber.

14. The apparatus of claim 13, wherein said flaps are made of any suitable resilient material.

15. The apparatus of claim 14, wherein said valve assembly housing is generally cylindrical.

16. The apparatus of claim 15, wherein said valve member is generally spherical.

17. The apparatus of claim 16, wherein said lower, valve seat of said valve assembly is generally annular.

* * * * *